US011297450B2

(12) United States Patent
Neher et al.

(10) Patent No.: US 11,297,450 B2
(45) Date of Patent: Apr. 5, 2022

(54) METHOD FOR OPERATING A HEARING SYSTEM, A HEARING SYSTEM AND A FITTING SYSTEM

(71) Applicant: Sonova AG, Stafa (CH)

(72) Inventors: Tobias Neher, Oldenburg (DE); Michael Boretzki, Ruti (CH); Ralph Peter Derleth, Hinwil (CH); Volker Kuhnel, Mannedorf (CH); Ullrich Sigwanz, Hombrechtikon (CH); Matthias Latzel, Eggolsheim (DE); Olaf Strelcyk, Loveland, OH (US); Sascha Liebe, Hombrechtikon (CH)

(73) Assignee: SONOVA AG, Stäfa (CH)

( * ) Notice: Subject to any disclaimer, the term of this patent is extended or adjusted under 35 U.S.C. 154(b) by 260 days.

(21) Appl. No.: 16/486,939

(22) PCT Filed: Feb. 20, 2017

(86) PCT No.: PCT/EP2017/053744
§ 371 (c)(1),
(2) Date: Aug. 19, 2019

(87) PCT Pub. No.: WO2018/149507
PCT Pub. Date: Aug. 23, 2018

(65) Prior Publication Data

US 2021/0297796 A1 Sep. 23, 2021

(51) Int. Cl.
*H04R 25/00* (2006.01)

(52) U.S. Cl.
CPC ..... *H04R 25/70* (2013.01); *H04R 25/40* (2013.01); *H04R 25/505* (2013.01); *H04R 25/552* (2013.01)

(58) Field of Classification Search
CPC ..... H04R 25/00
(Continued)

(56) References Cited

U.S. PATENT DOCUMENTS

| | | | | |
|---|---|---|---|---|
| 9,407,999 | B2 * | 8/2016 | Brown | H04R 25/43 |
| 2009/0304203 | A1 * | 12/2009 | Haykin | G10L 21/02 381/94.1 |

(Continued)

FOREIGN PATENT DOCUMENTS

| | | |
|---|---|---|
| EP | 2 360 943 A1 | 8/2011 |
| EP | 2 683 179 A1 | 1/2014 |
| EP | 2 993 915 A1 | 3/2016 |

OTHER PUBLICATIONS

International Search Report for PCT/EP2017/053744, dated May 15, 2017.

(Continued)

*Primary Examiner* — Suhan Ni
(74) *Attorney, Agent, or Firm* — Pearne & Gordon LLP

(57) ABSTRACT

A method for operating a hearing system worn by a user, the hearing system being a binaural hearing system including first and second hearing aids and being prepared for processing a sound. The processing includes a beamforming which can be adjusted to at least a first beamforming mode and a second beamforming mode. The method includes receiving sound by the hearing system, determining whether the beamforming is to be adjusted to the first beamforming mode or the second beamforming mode and adjusting the beamforming accordingly and generating a processed sound, and presenting the processed sound to the user.

23 Claims, 3 Drawing Sheets

(58) Field of Classification Search
USPC ..... 381/312–321
See application file for complete search history.

(56) References Cited

U.S. PATENT DOCUMENTS

| | | | | |
|---|---|---|---|---|
| 2010/0002886 | A1* | 1/2010 | Doclo | H04R 25/552 381/23.1 |
| 2012/0215519 | A1* | 8/2012 | Park | G10L 21/0208 704/2 |
| 2016/0183011 | A1* | 6/2016 | Gran | H04R 25/453 381/23.1 |
| 2016/0205483 | A1* | 7/2016 | Riis | H04R 25/70 381/23.1 |
| 2018/0103327 | A1* | 4/2018 | Mosgaard | H04R 25/552 |

OTHER PUBLICATIONS

Written Opinion for PCT/EP2017/053744, dated May 15, 2017.
Lorenzo Picinali et al., Monolateral and Bilateral Fitting with Different Hearing Aids Directional Configurations, AES 128th Convention, London, UK May 22-25, 2010.
Office Action for corresponding European application No. 17705896.3 dated Mar. 22, 2021.

* cited by examiner

METHOD FOR OPERATING A HEARING SYSTEM, A HEARING SYSTEM AND A FITTING SYSTEM

TECHNICAL FIELD

The present invention is related to a method for operating a hearing system, wherein said hearing system being a binaural hearing system comprising a first and second hearing aids. Further, the present invention is related to such hearing system. Furthermore, the present invention is related to a fitting system.

BACKGROUND OF THE INVENTION

Hearing systems can offer binaural processing of sounds in order to improve speech understanding of the user in e.g. noisy communication situations. Such hearing system can comprise a first and second hearing aids, wherein the hearing system can be used for a binaural supply of surrounding sound to the user. This kind of hearing system is also referred to as a binaurally coupled hearing system or rather binaural hearing system. In operation, the hearing aids cooperate with each other by using a communication link, in particular a wireless connection. The hearing aids itself can be used to improve the hearing capability or communication capability of the user. The hearing aids may each pick up the surrounding sound with at least one microphone and process the microphone signal, respectively, thereby taking into account the hearing preferences of the user. The processed sound signal is provided to the ear canal of the user via a miniature loudspeaker, commonly referred to as a receiver.

In binaural processing the applied algorithm can have a predefined directional characteristic and combination of input signals provided by both hearing aids. In the research community binaural algorithms are described and there is typically a tradeoff between strong directivity versus preserving binaural cues to the listener. A psychoacoustic test, binaural detection threshold, $N_0S_{pi}$ test can assess the capability of the hearing system user to use Interaural Time Differences (ITDs) for binaural processing. This procedure in the literature is also known as part of the Binaural Masking Level Difference (BMLD). Where the BMLD is the difference between $N_0S_0$ and a $N_0S_{pi}$ test condition. Those hearing system user can benefit from Interaural Level Difference (ILD) for localization of sounds as well as separating spatially separated listening objects.

Binaural hearing systems known in the art have reduced user acceptance since hearing system users have reported that they suffer unnatural listening condition.

It is therefore an object of the present invention to provide a method for operating a hearing system, which method solves the problems known in the state of the art.

SUMMARY OF THE INVENTION

The present invention is directed to a method for operating a hearing system worn by a user, said hearing system being a binaural hearing system comprising a first and a second hearing aids. Said hearing system being prepared for processing a sound, said processing comprising a beamforming which can be adjusted to at least a first beamforming mode and a second beamforming mode. Said method comprises the steps of: receiving sound by the hearing system, determining whether said beamforming is to be adjusted to the first beamforming mode or the second beamforming mode and adjusting the beamforming accordingly and generating a processed sound, presenting the processed sound to the user. Said first beamforming mode substantially preserves one or more binaural cues comprised in said sound whereas the second beamforming mode modifies the one or more binaural cues comprised in said sound, wherein the determining depends on a binaural performance level of the user, said binaural performance level being indicative of the ability of the user to distinguish binaural cues of sounds.

Hence, provided is a method for operating a hearing system which method is able to predict which client will profit most from which kind of binaural processing in the hearing system. The inventive method allows binaural beamforming which is individualized and fitted to the individual needs or preferences. This method increase individual benefit for understanding speech in noisy situations while preserving binaural cues that are important for e.g. natural sound perception and localization. In an example, in the wording "the second beamforming mode modifies the one or more binaural cues comprised in said sound" the term modifying means that the one or more binaural cues are cancelled completely or attenuated in a specific range.

In an embodiment of the proposed method said binaural cues are one of a latency between the sound arriving at a right and left ear of the user, a sound pressure level difference between the sound arriving at the right and left ear of the user, a loudness difference between the sound arriving at the right and left ear of the user, and a frequency response difference between the sound arriving at the right and left ear of the user. Due to the acoustic head shadow of the user, the sound arrives to the hearing aids with different levels and/or reduced high-frequency amplitude. In an example, those hearing aid which is worn on the side facing away from the sound source receives a reduced sound pressure level.

In an embodiment of the proposed method the second beamforming mode substantially preserves at least one binaural cue, said at least one binaural cue being different from the one or more binaural cues which are modified.

In an embodiment of the proposed method the modifying of one or more binaural cues comprises reducing one or more binaural cues. In an example, the binaural cues can even be cancelled. In an example, with poor binaural function the hearing system can be configured to a strong broadband binaural beamforming mode with no or only minimal preservation of binaural cues. In doing so, the user wearing the hearing system gets the maximum binaural pre-processing because his "own binaural processor" does not give him a significant benefit.

In an embodiment of the proposed method the modifying of one or more binaural cues comprises enhancing the one or more binaural cues, introducing the one or more binaural cues, and/or converting the one or more binaural cues. In an embodiment, the binaural performance level is frequency dependent.

In an embodiment of the proposed method the binaural performance level is assessed during a fitting session. The fitting session allows to introduce binaural performance diagnostics.

In an embodiment, the fitting session comprises preconfiguring the hearing system. In case of the user shows poor binaural performance level the hearing system can be configured to a strong broadband binaural beamforming mode with no or only minimal preservation of binaural cues. In this case, the user of the hearing system gets the maximum binaural pre-processing and hence signal-to-noise-ratio improvement because his "own binaural processor" does not give him a significant benefit.

On the other hand, in case of the user shows good (residual) binaural performance level the setting of the binaural beamformer can be less aggressive such that more binaural cues of the signal are preserved.

In an embodiment of the proposed method the step of assessing the binaural performance level comprises conducting a psychoacoustic test of a binaural masking threshold. In an example, stimuli can be presented to the hearing system user via headphones, directly by the two hearing aids or streamed wirelessly to the hearing aids or is generated synchronized in the two hearing aids. The psychoacoustic test can distinguish between good and poor binaural performance level.

In an embodiment of the proposed method the psychoacoustic test comprises one of measuring a Binaural Masking Level Difference, BMLD, experienced by the user, and/or measuring a Binaural Masking Time Difference, BMTD, experienced by the user. In an embodiment, the binaural performance level is assessed at least in a first frequency-range and a second frequency-range. In an embodiment, the first frequency-range is above 1 kHz and the second frequency-range is below 2 kHz. In an example, the Binaural Masking Level Difference BMLD ($N_0S_{pi}$ vs $N_0S_0$) experienced by the user can be measured at the first frequency-range above 1 kHz and the second frequency-range below 2 kHz. Depending on the outcome of the test, the hearing system can be configured to a strong broadband binaural beamforming mode with no or only minimal preservation of binaural cues, if the measuring of the BMLD experienced by the user results in the user has poor binaural performance level. Otherwise, the setting of the binaural beamformer can be less aggressive such that more binaural cues of the signal are preserved, if the measuring of the BMLD results in the user has good binaural performance level. This psychoacoustic test shows to be a good predictor for binaural integration.

In an embodiment of the proposed method the binaural performance level is stored in the hearing system as a default value. In a further embodiment, the default value is dependent on a hearing loss of the user.

In an embodiment of the proposed method the determining comprises an evaluating of the sound. In a further embodiment, said evaluating is performed by the user via a user interface.

In a further embodiment, said evaluating comprises classifying the sound by the hearing system. This embodiment relates to a case in which no fitting test as mentioned above is conducted but rather the sound or rather the acoustic environment is classified by the hearing system itself. In other words, the configuration of the binaural beamformer is adjusted according to the acoustic environment rather than during a fitting session.

In an embodiment of the proposed method said classifying comprises detecting at least one of an acoustic diffusiveness of the sound, a reverberant signal comprised in the sound, and occurrence of lateral jammers in the sound. In one aspect, the sound classification according to the acoustic diffusiveness of the sound is derived from a binaural correlation of the incoming sound. In other words, the classification is based on diffusiveness prevailing in the (current) acoustic environment. In an aspect, in case of the hearing system classifies the environment as diffuse, the binaural beamformer can be adjusted towards full diotic output, i.e. identical signals on both ears (broadband full binaural beamformer), in order to achieve highest improvement of directivity index (DI). A reverberant situation with multiple distant jammers is more diffuse than a situation with few discrete jammers (i.e. concurrent talkers nearby). In an aspect, in case of the hearing system classifies the environment as comprising separate discrete lateral jammers, the binaural beamformer can be configured such to preserve the monaural signal in the high frequencies typically e.g. above 1-1.6 kHz or the binaural beamformer can be configured such to preserve binaural cues e.g. below 1-2 kHz, i.e. a high-frequency or low-frequency binaural beamformer.

In an embodiment of the proposed method the beamforming comprises a preprocessing of the sound, said preprocessing being one of noise cancelling and an automatic gain control. In an example, depending on the outcome of the binaural performance a diagnostic test sound cleaning can be activated differently. In one example, in case of the classifying results in a poor binaural performance value, the hearing system is controlled such to activate stronger noise cancelling or rather sound cleaning. Further control parameters can comprise automatic gain control which can comprise but are not limited to compression, limiting, expanding of the sound. These functions can dynamically adapt the gain in dependence of the amplitude of the sound signal.

In an embodiment, the method further comprises the step of, if the binaural performance level is determined to be poor, switching the hearing system on full beamformer and applying processing means adapted to preserve and/or enhance Interaural Level Differences, ILDs. Hence, for users with poor binaural function, the hearing system switches on full beamformer and applies additional methods to preserve or enhance ILDs.

In an embodiment of the proposed method, the processing means comprises at least one of ITD-to-ILD conversion at low frequencies, ILD transposition from high to low frequencies, ILD enhancement, and AGC coupling.

In an embodiment of the proposed method the processing means is provided with speech input signals before beamforming and applies the processing result after beamforming. The processing means can use the input signals before beamforming as input but may apply the processing result after beamforming.

Moreover, the present invention is directed to a hearing system to be worn by a user, said hearing system comprising a first and a second hearing aids and a user interface. The hearing system being a binaural hearing system prepared for processing a sound, said processing comprising a beamforming which can be adjusted to at least a first beamforming mode and a second beamforming mode. Said hearing system comprises a means for evaluating said sound, a determining means for determining whether said beamforming is to be adjusted to the first beamforming mode or the second beamforming mode, and adjusting the beamforming accordingly, and a processing means for executing the determined beamforming mode in the hearing system. The first beamforming mode substantially preserves one or more binaural cues comprised in said sound whereas the second beamforming mode modifies the one or more binaural cues comprised in said sound. The determining depends on the evaluation of the sound and of a binaural performance level of the user, said binaural performance level being indicative of the ability of the user to distinguish binaural cues of sounds. Hence, provided is a binaural hearing system which presents increased individual benefit for understanding speech in noisy situations while preserving binaural cues that are important for natural sound perception and localization. This provides improved sound classification and steering of the binaural beamformer alone or in combination with a diagnostic procedure during a fitting session.

Moreover, the present invention is directed to a fitting system adapted for fitting a hearing system according to claim 23. In an embodiment, the proposed fitting system is prepared for executing a psychoacoustic test to determine binaural hearing ability of a user wearing the hearing system. In a further embodiment, the fitting system is adapted to determine default values for the binaural performance level from a hearing loss.

It is expressly pointed out that any combination of the above-mentioned embodiments is subject of further possible embodiments. Only those embodiments are excluded that would result in a contradiction.

BRIEF DESCRIPTION OF THE DRAWINGS

The present invention is further described with reference to the accompanying drawings jointly illustrating various exemplary embodiments which are to be considered in connection with the following detailed description. What is shown in the figures is.

DETAILED DESCRIPTION OF THE INVENTION

Figure 1:
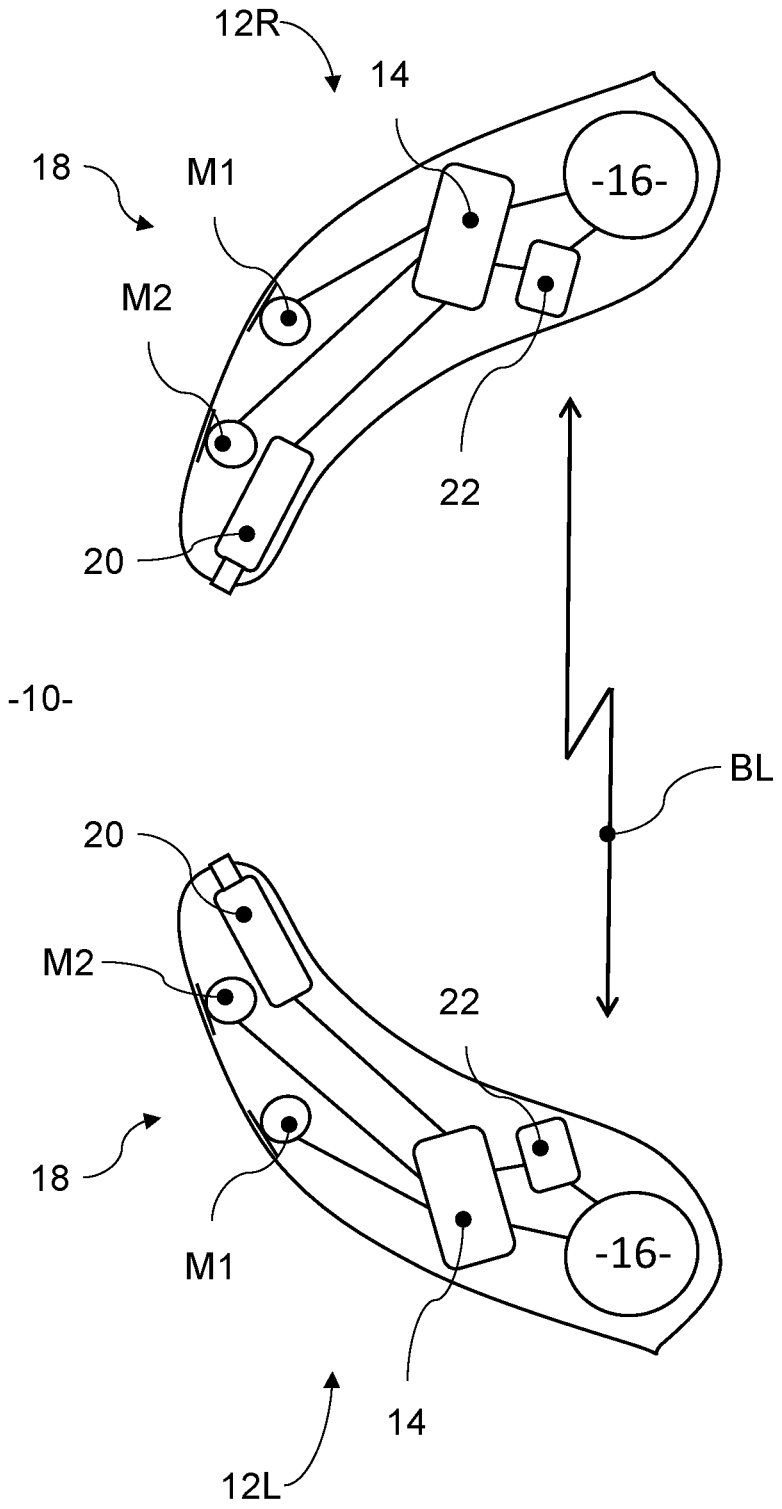
FIG. 1 schematically depicts a binaural hearing system comprising a left hearing aid and a right hearing aid.

FIG. 1 schematically depicts a binaural hearing system 10 comprising a left hearing aid 12L and a right hearing aid 12R. The exemplarily shown binaural hearing system 10 offers binaural processing of sound in order to improve e.g. speech understanding in noisy communication situations.

Each of said hearing aids 12L, 12R comprises a processor 14 connected to a battery 16, respectively. Further comprised is a microphone arrangement 18, which can preferably comprise two microphones M1, M2 for picking up sound. The sound can be processed by the processor 14 and output to the ear canal of the user by means of a receiver 20. Both hearing aids 12L, 12R are operatively connected to each other. The connection can be established based on a wireless technique, e.g. via a binaural link BL established by means of a wireless interface 22 comprised in each of said hearing aids 12L, 12R, respectively. In another example, the connection can be established based on a wired technique.

As mentioned above, the binaural hearing system 10 offers binaural processing of sound. The algorithm provides a solution to improve intelligibility in complex listing situations for the hearing system user by means of binaural hearing, wherein the algorithm applied can involve predefined directional characteristics and a combination of signals which are input into both hearing aids 12L, 12R.

In operation, the hearing system 10 combines the signal of the two microphone systems in the left and right hearing aids 12L, 12R via the binaural link BL and then processes them. In the algorithm, a tradeoff can be made between strong directivity versus preserving binaural cues to the user. The distance between the left and right microphones M1 and M2 in each hearing aid 12L, 12R allows to differentiate between the individual microphone signals from different points in the environment, e.g. in a room, allowing to provide a more effective spatial effect, in particular at lower frequencies. This is important in terms of spatial perception and localization.

A binaural beamformer with broadband diotic output, which provides identical signals on both ears, provides good performance with respect to directivity index improvement. Further, improved suppression in a diffuse noise field can be achieved. However, identical directional characteristics on the right end left side would result in a diotic perception of sound that lacks directional information for lateralization. To put it in other words, this approach results in loss of binaural cues comprising Interaural Time Difference (ITD) and Interaural Level Difference (ILD). Users have reported that this provides unnatural listening condition.

One solution might be to introduce a band specific mixing of ipsi- and contralateral signals in order to preserve some of the binaural cues. By applying a binaural beamformer in the lower frequencies, e.g. below 1-2 kHz, and a monaural beamformer in the higher frequencies, e.g. above 1-1.6 kHz, interaural level difference (ILD) due to the head shadow effect at higher frequencies are preserved. It is to be noted the frequencies set out above are only exemplary. However, binaural beamforming at higher frequencies only keeps interaural time differences (ITD) intact. There is no diagnostic known in the art that allows to predict which hearing system user will profit most from which kind of binaural processing. In other words, binaural beamforming known in the art is not individualized and fitted to the individual needs or preferences and binaural processing is not adapted to the acoustic environment depending on the diffusiveness of the sound field.

Figure 2:
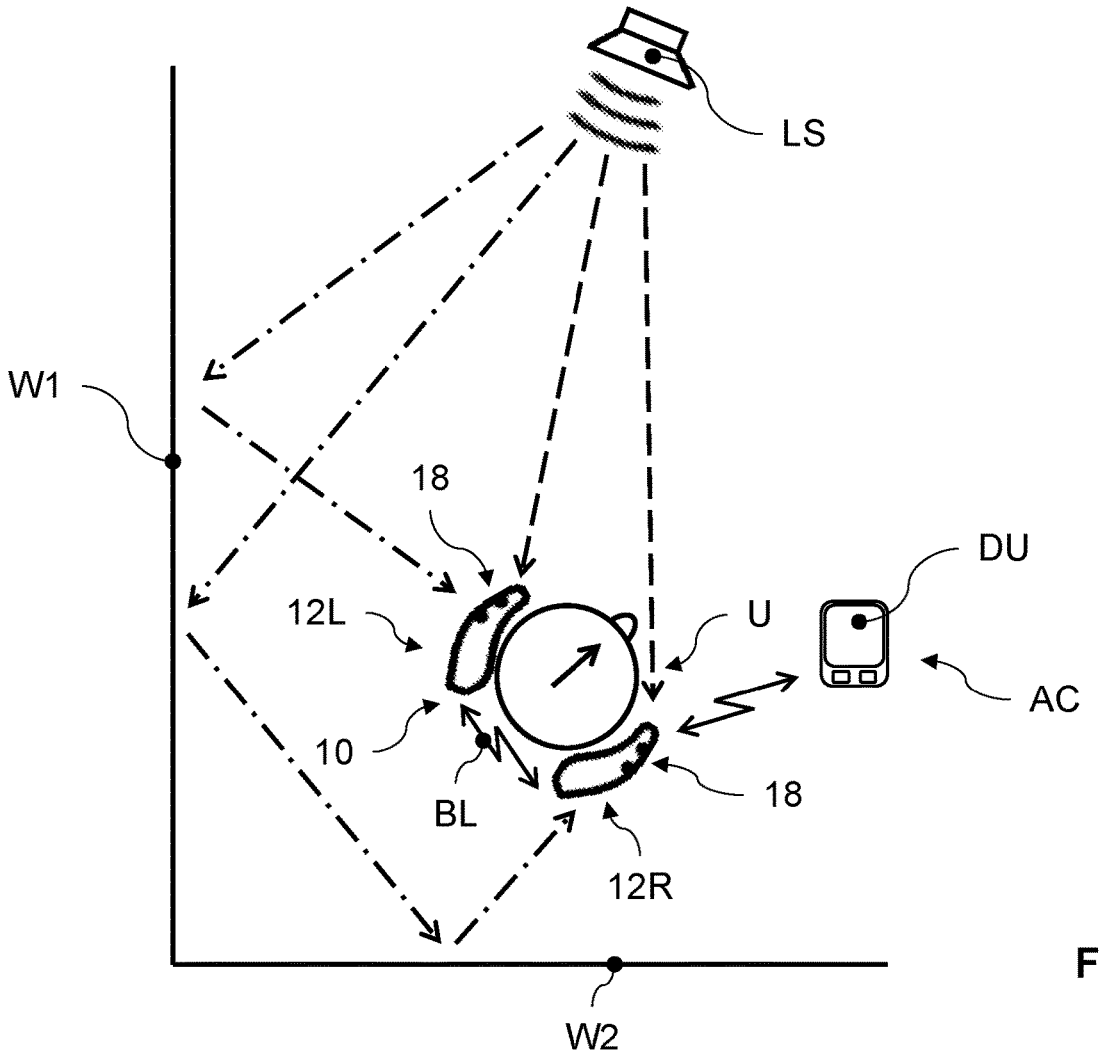
FIG. 2 schematically depicts a method for operating the binaural hearing system according to a first embodiment.
Figure 3:
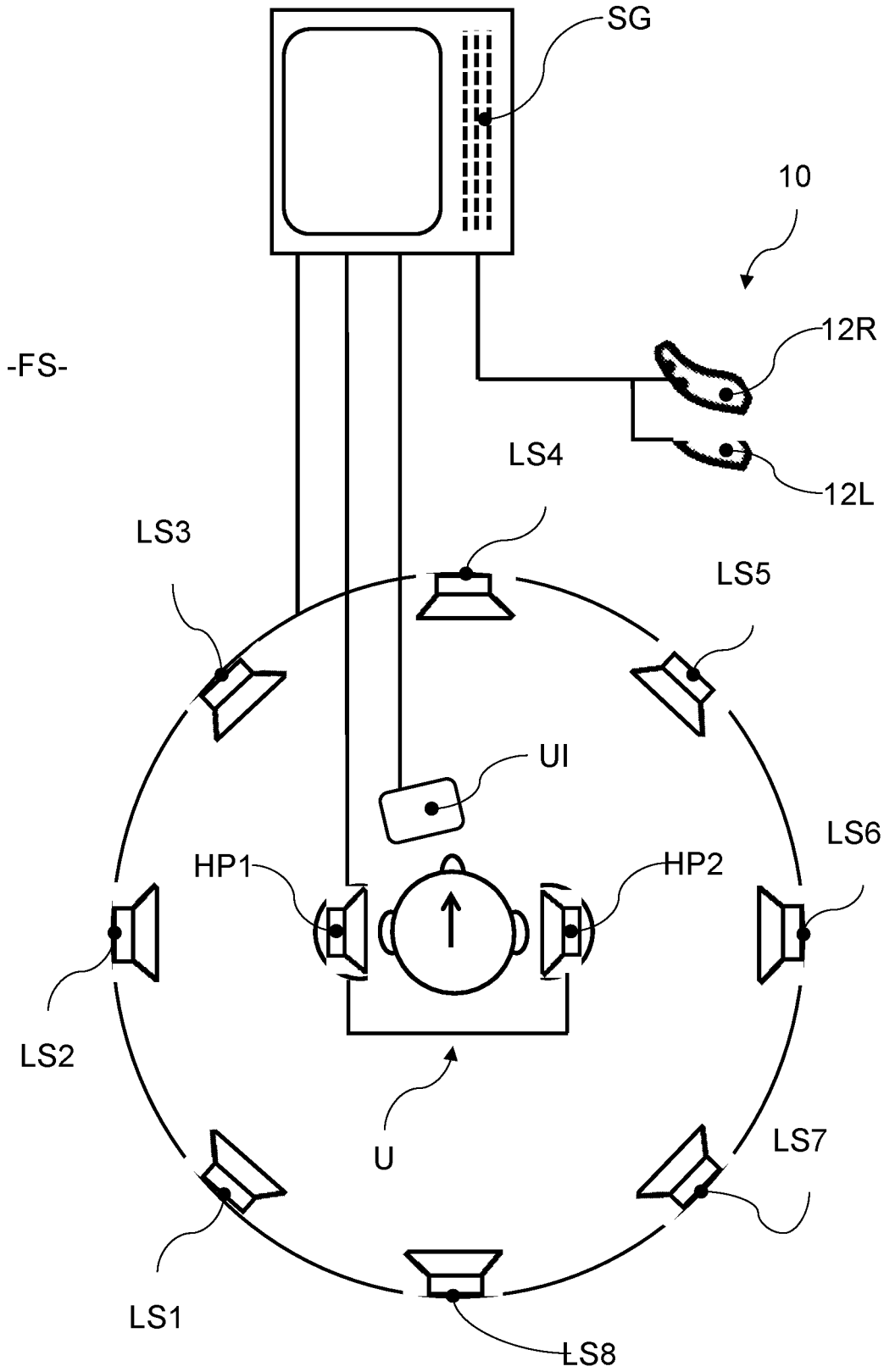
FIG. 3 schematically depicts a method for operating the binaural hearing system according to a second embodiment.

FIGS. 2 and 3 schematically depict a method for operating the binaural hearing system 10 according to a first and second embodiments of the present invention. In the embodiment as shown in FIG. 2, the step of evaluating the acoustic environment is performed by classifying the acoustic environment by the hearing system 10, whereas FIG. 3 shows preconfiguring the hearing system 10 during a fitting session for assessing the binaural performance level.

Referring back to FIG. 2, said figure schematically shows a method for operating the hearing system 10 in a reverberant environment, e.g. a room with solid walls W1, W2. This environment introduces acoustic diffusiveness of a sound output from a loudspeaker LS. A user U placed in this environment is wearing the hearing system 10 comprising the left and right hearing aids 12L, 12R. The user U is looking in a direction towards the center of the room (as indicated by a solid line arrow). The sound output from the loudspeaker LS reaches the hearing aids 12L, 12R directly (as indicated by dashed arrows) and indirectly (as indicated by dash-doted arrows) due to reflecting objects, i.e. the walls W1, W2. Both hearing aids 12L, 12R can communicate with each other via the binaural link BL, allowing to cooperatively process the input sound, e.g. by beamforming. The beamforming is used in order to reduce noise in the hearing aids 12L, 12R by focusing on the direction of the targeted sound output from the loudspeaker LS. In the shown example, by focusing towards the target sound, interfering noise can essentially be eliminated.

In the embodiment as shown in FIG. 2, the beamforming mentioned above can be adjusted to a first beamforming mode and a second beamforming mode. In another example, the beamforming can be adjusted to more than two beamforming modi. The method evaluates the acoustic environment prevailing in the scenario as depicted in FIG. 2 comprising the reverberant sound. Based on the evaluation, the hearing system 10 determines whether the beamforming is to be adjusted to the first beamforming mode or the second beamforming mode. Said determining can be performed in one or both of the processors comprised in the hearing aids 12L, 12R (refer to FIG. 1). In the hearing system 10, the beamforming is adjusted according to the determining step. Further, the user U is presented the processed sound.

According to the invention, on the one hand, the first beamforming mode substantially preserves one or more binaural cues comprised in the sound. On the other hand, the second beamforming mode modifies the one or more binaural cues comprised in said sound. In doing so, the determining depends on a binaural performance level of the user, wherein said binaural performance level indicates or rather being indicative of the user U ability to distinguish binaural cues of sounds. In an example, said binaural cues are a latency between the sound arriving at the right and left ear of the user. In another example said binaural cues are a sound pressure level difference between the sound arriving at the right and left ear of the user. In another example said binaural cues are a loudness difference between the sound arriving at the right and left ear of the user. In another example said binaural cues are a frequency response difference between the sound arriving at the right and left ear of the user. It is to be noted that at least some of the examples mentioned above can be combined.

In the sound environment as depicted in FIG. 2, the evaluating step is performed by classifying the acoustic environment by the hearing system. In other words, the respective acoustic is picked up by the microphones of both hearing aids 12L, 12R in order to evaluate at least one of the acoustic diffusiveness of the sound, a reverberant signal comprised in the sound, and occurrence of lateral jammers in the sound. It is to be noted that the term "sound" means the (respective) sound prevailing in the acoustic environment.

The hearing system can be controlled by a user interface, which is in the shown example an accessory device AC, which establishes a communication with the hearing system, e.g. via a wireless connection. The accessory device AC can be used to perform settings to the hearing system and/or to notify the user U about a status thereof via a display unit DU. In an example, the accessory device AC can be a smartphone or a touchscreen portable device.

FIG. 3 schematically depicts a method for operating the binaural hearing system according to the second embodiment of the present invention. In this embodiment, the hearing system is preconfigured during a fitting session performed in a fitting system FS for assessing the binaural performance level. This fitting session is exemplified in the FIG. 3 as a binaural hearing test setup. During the fitting session, the user U is exposed to sounds generated by a test equipment of the fitting system FS. This test equipment comprises a plurality of circumferentially arranged loudspeakers LS1-LS8 for presenting test sounds to the user U. In an aspect, the test sounds can be presented to the user U via headphones HP1, HP2. In another aspect, the test sounds can be input to the left and right hearing aids 12L, 12R, directly. While the connection between the sound generator and the hearing aids 12L, 12R of the hearing system is shown to be a wired connection, said connection is preferably a wireless connection.

The test sounds are generated by a sound generator SG comprised by the test equipment, wherein the sound generator SG supplies the test sounds to one of the loudspeakers LS1-LS8, the headphones HP1, HP2 and the left and right hearing aids 12L, 12R. The test equipment of the fitting system FS further comprises a user interface UI adapted to receive feedback input by the user U during the fitting session.

During the fitting session, the binaural performance level is assessed by performing a psychoacoustic test of a binaural masking threshold. The assessment is preferably performed by supplying the test signal to the user by means of headphones configured to completely prevent crosstalk between both ears or rather sound sources (left/right).

During the assessment, e.g. a $N_0S_{pi}$ test primarily assesses the capability of the user to use Interaural Time Differences ITDs for binaural processing. Those users have to rely on Interaural Level Difference ILD as primary for localization. The psychoacoustic test comprises measuring a Binaural Masking Level Difference, BMLD, experienced by the user. Alternatively or as an option, the psychoacoustic test can comprise measuring a Binaural Masking Time Difference, BMTD, experienced by the user. The binaural performance level can be assessed in a first frequency-range and a second frequency-range, wherein the first frequency-range can be above 1 kHz and the second frequency-range can be below 2 kHz. Depending on the use-case, any other frequency-ranges can be used if necessary. The binaural performance level can be stored in the hearing system as a default value. This default value can depend on a hearing loss of the user U. In an example, the binaural masking level difference, BMLD, ($N_0S_{pi}$ vs. $N_0S_0$) can be performed in a range between 200 and 1000 Hz. The BMLD measurement is a superior psychoacoustic test which is shown to be a good predictor for binaural integration.

If the test reveals that the user U shows poor binaural processing capabilities, i.e. the test results in a low binaural performance level of the user, wherein the binaural performance level is indicative of the ability of the user to distinguish binaural cues of sounds, the hearing system can be configured to a strong broadband binaural beamforming mode with no or only little preservation of binaural cues. In doing so, the hearing system of the user U can be adjusted to the maximum binaural preprocessing since the "binaural processor of the user U" does not give him a significant benefit. However, if the test reveals that the user shows good binaural processing capabilities, i.e. the test results in a high binaural performance level of the user U, the beamformer is set to be less aggressive, such that more binaural cues of the signal are preserved.

The evaluating step can be carried out or rather performed by the user in a respective environment the user is currently in. In this case, the evaluating step can be performed via the user interface. In an example, the user interface is a user control of the hearing aid, a remote control or a smartphone. In a preferred example, the evaluating step is performed via an app loaded and executable in the smartphone. The app can be configured such to display at least one preset button, slide control, etc. on the display of the smartphone as well as to allow the user to perform the evaluating step by adjusting the at least one preset button, slide control, etc. on the display of the smartphone, directly.

What is claimed is:

1. A method for operating a hearing system (10) worn by a user (U), said hearing system (10) being a binaural hearing system (10) comprising a first and second hearing aids (12L,12R), said hearing system (10) being prepared for processing a sound, said processing comprising a beamforming which can be adjusted to at least a first beamforming mode and a second beamforming mode, said method comprising:

receiving sound by the hearing system;

determining whether said beamforming is to be adjusted to the first beamforming mode or the second beamforming mode and adjusting the beamforming accordingly and generating a processed sound;

presenting the processed sound to the user (U);

wherein said first beamforming mode substantially preserves one or more binaural cues comprised in said sound whereas the second beamforming mode modifies the one or more binaural cues comprised in said sound, and wherein the determining depends on a binaural performance level of the user (U), said binaural performance level being indicative of the ability of the user (U) to distinguish binaural cues of sounds, wherein:

the binaural performance level is assessed during a fitting session, assessing the binaural performance level comprises conducting a psychoacoustic test of a binaural masking threshold, and the psychoacoustic test comprises one of:

measuring a Binaural Masking Level Difference, BMLD, experienced by the user (U), and measuring a Binaural Masking Time Difference, BMTD, experienced by the user (U).

2. The method of claim 1, wherein said binaural cues are one of:

a latency between the sound arriving at a right and left ear of the user (U), a sound pressure level difference between the sound arriving at the right and left ear of the user (U), a loudness difference between the sound arriving at the right and left ear of the user (U), and a frequency response difference between the sound arriving at the right and left ear of the user (U).

3. The method of claim 2, wherein modifying one or more binaural cues comprises reducing one or more binaural cues.

4. The method of claim 1, wherein the second beamforming mode substantially preserves at least one binaural cue, said at least one binaural cue being different from the one or more binaural cues which are modified.

5. The method of claim 2, wherein modifying one or more binaural cues comprises one of:

enhancing the one or more binaural cues, introducing the one or more binaural cues, and converting the one or more binaural cues.

6. The method according to claim 1, wherein the binaural performance level is frequency dependent.

7. The method according to claim 1, wherein the fitting session comprises preconfiguring the hearing system (10).

8. The method according to claim 1, wherein the binaural performance level is assessed at least in a first frequency-range and a second frequency-range.

9. The method according to claim 8, wherein the first frequency-range is above 1 kHz and the second frequency-range is below 2 kHz.

10. The method according to claim 1, wherein the binaural performance level is stored in the hearing system (10) as a default value.

11. The method of claim 10, wherein the default value is dependent on a hearing loss of the user (U).

12. The method according to claim 1, wherein determining comprises an evaluating of the sound.

13. The method according to claim 12, wherein said evaluating is performed by the user (U) via a user interface.

14. The method according to claim 12, wherein said evaluating comprises classifying the sound by the hearing system (10).

15. The method according to claim 14, wherein said classifying comprises detecting at least one of:

an acoustic diffusiveness of the sound, a reverberant signal comprised in the sound, occurrence of lateral jammers in the sound.

16. The method according to claim 1, wherein the beamforming comprises a preprocessing of the sound, said preprocessing being one of:

a noise cancelling, and an automatic gain control.

17. The method according to claim 1, further comprising the step of:

if the binaural performance level is determined to be poor, switching the hearing system on full beamformer and applying processing means adapted to preserve and/or enhance Interaural Level Differences, ILDs.

18. The method according to claim 17, wherein the processing means comprises at least one of ITD-to-ILD conversion at low frequencies, ILD transposition from high to low frequencies, ILD enhancement, and AGC coupling.

19. The method according to claim 17, wherein the processing means is provided with speech input signals before beamforming and applies the processing result after beamforming.

20. A hearing system (10) to be worn by a user (U), said hearing system (10) comprising a first and a second hearing aids (12L,12R) and a user interface, said hearing system (10) being a binaural hearing system (10) prepared for processing a sound, said processing comprising a beamforming which can be adjusted to at least a first beamforming mode and a second beamforming mode, said hearing system comprising:

a means for evaluating said sound;

a determining means for determining whether said beamforming is to be adjusted to the first beamforming mode or the second beamforming mode, and adjusting the beamforming accordingly;

a processing means for executing the determined beamforming mode in the hearing system;

wherein said first beamforming mode substantially preserves one or more binaural cues comprised in said sound whereas the second beamforming mode modifies the one or more binaural cues comprised in said sound, and wherein the determining depends on the evaluation of the sound and of a binaural performance level of the user (U), said binaural performance level being indicative of the ability of the user to distinguish binaural cues of sounds, wherein the binaural performance level is assessed during a fitting session, wherein assessing the binaural performance level comprises conducting a psychoacoustic test of a binaural masking threshold, and wherein the psychoacoustic test comprises one of:

measuring a Binaural Masking Level Difference, BMLD, experienced by the user (U), and measuring a Binaural Masking Time Difference, BMTD, experienced by the user (U).

21. A fitting system (FS) adapted for fitting the hearing system (10) according to claim 20.

22. The fitting system (FS) according to claim 21 configured for executing a psychoacoustic test to determine binaural hearing ability of the user (U) wearing the hearing system (10).

23. The fitting system (FS) according to claim 21, adapted to determine default values for the binaural performance level from a hearing loss.

* * * * *